US008104132B2

(12) United States Patent
Mink

(10) Patent No.: US 8,104,132 B2
(45) Date of Patent: Jan. 31, 2012

(54) APPLICATOR BRUSH

(75) Inventor: Jeffrey Mink, Glen Head, NY (US)

(73) Assignee: FM Brush Company, Inc., Glendale, NY (US)

( * ) Notice: Subject to any disclaimer, the term of this patent is extended or adjusted under 35 U.S.C. 154(b) by 354 days.

(21) Appl. No.: 12/239,261

(22) Filed: Sep. 26, 2008

(65) Prior Publication Data

US 2010/0077559 A1 Apr. 1, 2010

(51) Int. Cl.
*A46B 9/02* (2006.01)

(52) U.S. Cl. ..... 15/160; 15/191.1; 15/DIG. 5

(58) Field of Classification Search ..... 15/191.1, 15/DIG. 5, 59, 65, 164, 167.1, 160; D4/127, D4/132, 135
See application file for complete search history.

(56) References Cited

U.S. PATENT DOCUMENTS 1,507,971 A * 9/1924 Lomp ..... 15/26
2,049,365 A * 7/1936 Follett ..... 15/164
2,117,174 A * 5/1938 Jones ..... 15/110
2,244,098 A * 6/1941 Busick ..... 15/172
2,819,482 A * 1/1958 Applegate ..... 15/110
3,964,122 A * 6/1976 Kurdy ..... 15/184
4,088,413 A * 5/1978 Rossignol de la Ronde et al. ..... 401/282
4,454,622 A * 6/1984 Poppendieck ..... 15/167.3
4,483,036 A * 11/1984 Sayklay ..... 15/160
5,373,599 A * 12/1994 Lemon et al. ..... 15/104.94
5,799,353 A * 9/1998 Oishi et al. ..... 15/167.1
D425,306 S * 5/2000 Beals et al. ..... D4/104
6,108,847 A * 8/2000 Cueman et al. ..... 15/104.94
D480,217 S * 10/2003 Mink ..... D4/127
D559,548 S * 1/2008 Dovellos ..... D4/135
2004/0003478 A1 1/2004 Mink

* cited by examiner

*Primary Examiner* — Randall Chin
(74) *Attorney, Agent, or Firm* — Keusey & Associates, P.C.

(57) ABSTRACT

An applicator brush is provided having a base tuft comprised of bristles affixed to a ferrule at a first end, the bristles having a second end terminating to form an edge. The brush includes a protruding tuft comprised of bristles configured to protrude from an interior portion of the base tuft. The interior portion of the base tuft comprises any location within a perimeter of the base tuft. A handle may be provided affixed to the ferrule.

17 Claims, 3 Drawing Sheets

APPLICATOR BRUSH

TECHNICAL FIELD OF THE INVENTION

The present invention generally relates to brushes and, more particularly, to applicator brushes with a protruding set of bristles being provided to protrude from a base set of bristles for providing improved product application of skin products, such as cosmetics.

BACKGROUND OF THE INVENTION

Brushes made with natural and/or synthetic bristles are used for a variety of activities involving the application of various products and substances. Specially designed brushes may be employed where specific control is needed during application of e.g., cosmetic/hygienic substances and materials.

There are numerous cosmetic and/or hygienic substances and materials provided in an array of forms designed for application to various surfaces, especially human skin. Regardless of the form of a cosmetic/hygienic material, e.g., whether in liquid, semi-liquid or solid forms, a primary object involves achieving application of the desired product(s) in a specific amount and at a particular location to achieve a desired effect.

Brushes having specialized forms for facilitating certain applicator effects have been introduced. For example, a brush having pillared bristles is disclosed in U.S. Published Application 2004/0003478 that is designed for use with a stencil mask as a fabric paintbrush or as an artist's paintbrush. Brushes having angular tips have also been introduced, e.g., to facilitate various artistic and coverage effects and designs.

However, such brushes are generally limited in their ability to provide different types of coverage effects in a single brush.

Accordingly, a brush, in particular, an applicator brush for providing improved flexibility and range of coverage effects during application of a variety of products, especially cosmetic products, is highly desirable.

SUMMARY OF THE INVENTION

The present invention provides an improved applicator brush instrument having a first set of bristles comprising a base tuft and a second set of bristles comprising a protruding tuft. The second set of bristles is preferably configured to be longer than, and thus protrude from, an interior portion of the first set of bristles.

The first and second sets of bristles each have a first end which is connected at a first end to a ferrule or bushing. The ferrule or bushing may comprise any shape (e.g., cylindrical, flattened, conical, star-shaped, any polygonal shape, etc.). Accordingly, the bristles may be caused to form any shape in accordance with the ferrule shape. The protruding tuft may be caused to be formed in a different or same bristle configuration, orientation and shape as the base tuft. Further, the edge shape of the protruding tuft may be the same or different from the edge shape of the base tuft.

Advantageously, a brush according to the present invention is adapted for providing an improved and wider range of use in a single brush, from tasks requiring detailed, precision application of materials, to work requiring broader coverage. Furthermore, a brush according to the present invention enables different types/colors of materials to be applied concurrently or separately with greater accuracy, and achieves desired applicator effects with ease and precision.

The bristles of a brush head according to an aspect of the present invention may be comprised of a single or multiple lengths and proportions and arranged and distributed in a tuft having any desired density. Accordingly, maximum take-up and effective application of various substances is facilitated.

According to one aspect, an applicator brush is provided comprising a base tuft comprised of bristles affixed to a ferrule at a first end, said bristles having a second end terminating to form an edge, and a protruding tuft comprised of bristles configured to protrude from an interior portion of the base tuft.

According to another aspect, an applicator brush is provided comprising a base tuft comprised of bristles affixed to a ferrule at a first end, said bristles having a second end terminating to form an edge, and a protruding tuft comprised of bristles configured to protrude from an interior portion of the first tuft, wherein the interior portion of the base tuft comprises any location within a perimeter of the base tuft. A handle may be provided affixed to the ferrule.

These and other aspects, features and advantages of the present invention will be described or become apparent from the following detailed description of preferred embodiments.

DETAILED DESCRIPTION OF PREFERRED EMBODIMENTS

Figure 1:
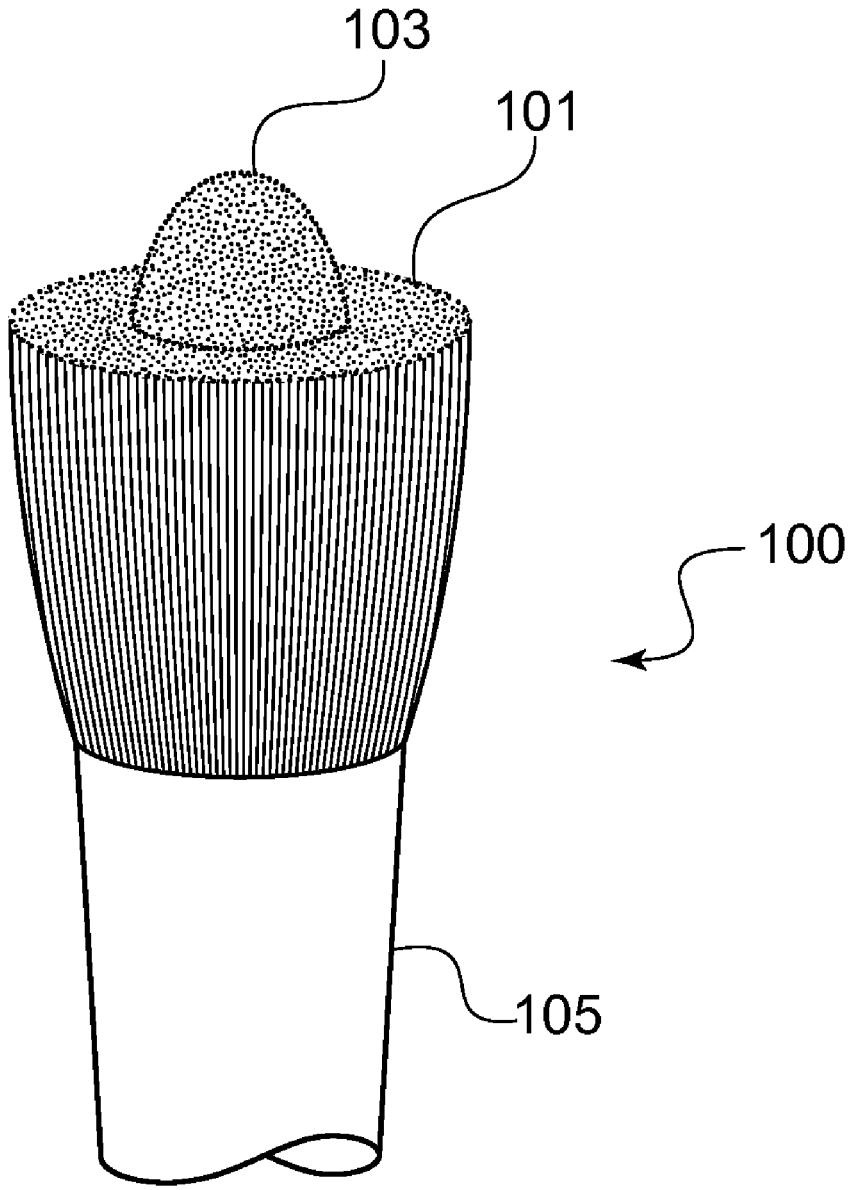
FIG. 1 is a top perspective view of a brush head according to an embodiment of the present invention.
Figure 2:
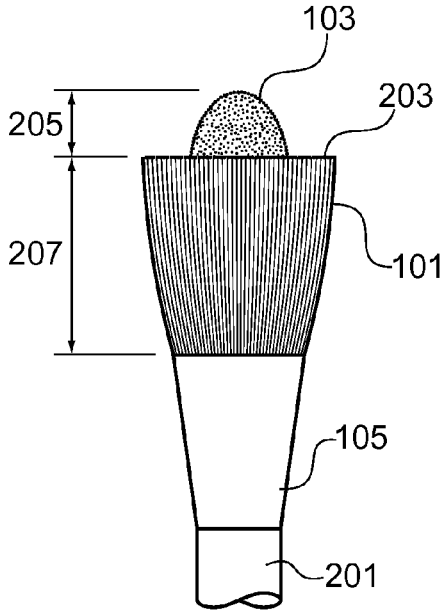
FIG. 2 is a side view of the brush head of FIG. 1.

Referring now to the Figures, FIGS. 1 and 2 show top perspective and side views of a brush head 100, respectively, according to an exemplary embodiment of the present invention. According to one aspect of the present invention, a first set of bristles comprising a base tuft 101 is provided comprised of a plurality of bristles having a first end secured to a ferrule or bushing 105. The base tuft 101 and the ferrule 105 may be comprised of any shape or size, e.g., cylindrical, polygonal, oval, flattened, conical, etc. The shape of the base tuft 101 may be determined, e.g., by the shape of the ferrule 105. The bristles of base tuft 101 may be cut to a single length so as to form a substantially level surface, as shown in FIGS. 1-2, or may be configured to be non-uniform in length (e.g., comprised of various lengths with respect to their point of attachment to the ferrule, some bristles being longer or shorter than others). For example, the bristle ends may be configured to terminate in a plurality of planes which further may be cut to collectively follow, e.g., a curved/angled plane or outline, to form various desired edge configurations.

In one exemplary embodiment, the ferrule 105 according to the present invention may be integrated with and comprise a handle 201 for a user to grasp and manipulate the brush 100. The ferrule 105 and handle 201 may be comprised of any material(s) in any shape, length, diameter, etc., and e.g., may be tapered and/or ergonomically shaped to facilitate grip, balance and ease of use. The ferrule 105 and tuft 101 may preferably share a common central axis. The bristles may be secured to the ferrule 105 in any suitable manner, for example, by being potted in epoxy. By way of non-limiting examples, the handle 201 can be of any shape and can be made from wood, plastic, synthetic materials, natural materials, acrylic, or any other material that is suitable for forming a brush handle. The handle 201 may be shaped to be ergonomic and/or incorporate other materials such as rubber grips, etc.

The base tuft 101 may be provided in any length, as per the desired application (e.g., cosmetic applicator brush, arts and crafts brush, etc.). Exemplary bristle lengths of the base tuft 101 may comprise e.g., ⅛ inches to about 2 inches.

According to another aspect of the present invention, a second tuft of bristles comprising a protruding tuft 103 may be provided, preferably extending beyond the bristles of the base tuft 101 at an interior portion thereof. The 'interior portion' of the base tuft may comprise any area or location within the perimeter 203 of the base tuft. For example, as shown in the embodiment depicted in FIGS. 1-2, the protruding tuft 103 may comprise a nipple or dome-shaped protrusion, extending from a center portion of the base tuft 101. Other shapes and configurations of the protruding tuft 103 may be contemplated as discussed further below. The protruding tuft 103 may be provided in any length, as per the desired application and relative to the base tuft 101. For example, the bristles of the protruding tuft 103 may be configured to extend beyond the end of the bristles of the base tuft 101 for a distance 205 of, e.g., at least about 20% of the length 207 of the base tuft.

Figure 3:
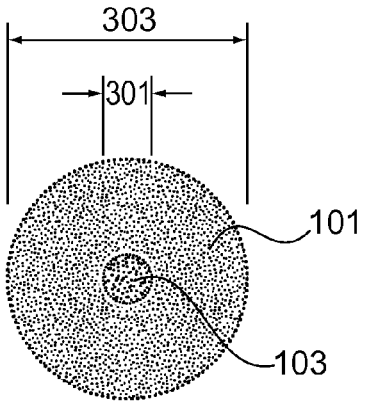
FIG. 3 is a top view of a brush according to an embodiment of the present invention.
Figure 4:
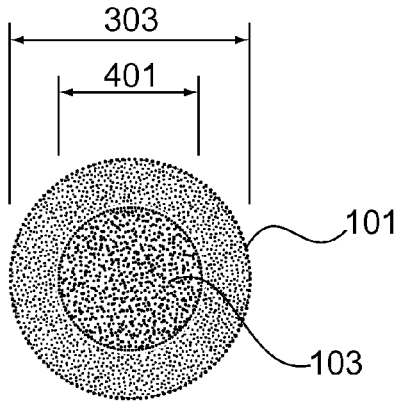
FIG. 4 is a top view of a brush according to another embodiment of the present invention.

FIGS. 3-7 depict top views of a brush according to various exemplary embodiments of the present invention. The protruding tuft 103 may comprise any shape or size, and may have any diameter relative to a diameter of the base tuft 101. For example, FIGS. 3 and 4 show protruding tufts 103 having different diameters relative to their respective base tufts 101. That is, FIG. 3 depicts a protruding tuft 103 having a smaller diameter 301 relative to the base tuft diameter 303, as compared the protruding tuft 103 shown in FIG. 4, which has a larger diameter 401 relative to the base tuft diameter 303.

The bristles of tufts 101, 103 may be comprised of natural fibers (such as natural animal hair or fibers), synthetic fibers, or any blend thereof. Synthetic fibers may comprise e.g., nylon, extruded thermoplastic materials, etc. or any combination thereof. Exemplary thermoplastic materials include polypropylene, styrene, polystyrene, polyethylene, ABS, PVC, PBT, polycarbonate, polyamide, polyester, polyurethane, etc. Thermoset plastics may also be used.

The bristles of tufts 101, 103 may further be treated to impart antimicrobial characteristics therein; for example, the bristles 101 may comprise, e.g., synthetic bristles treated or impregnated with an antimicrobial agent or compound.

The thickness of each individual bristle of tufts 101, 103 may comprise any desired amount or be within any desired range. In one exemplary embodiment, bristle thickness (diameter) may range from about 0.05 mm to about 0.25 mm. A number of bristles in tufts 101, 103 included in the brush 100 may be any amount so as to meet any desired tuft bristle density. Furthermore, a blend of bristles having different diameters, thicknesses, etc. may be incorporated within each tuft 101, 103 to produce, e.g., a desired texture and feel.

Figure 5:
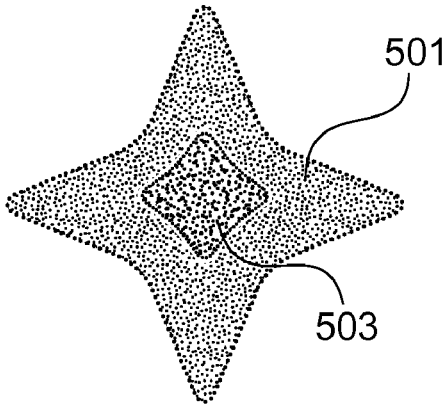
FIG. 5 is a top view of a brush according to another embodiment of the present invention.
Figure 6:
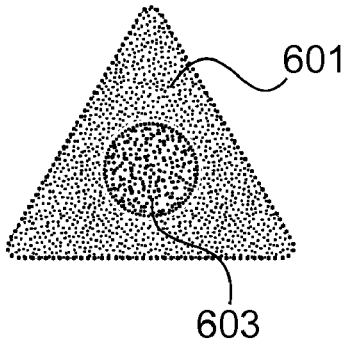
FIG. 6 is a top view of a brush according to another embodiment of the present invention.
Figure 7:
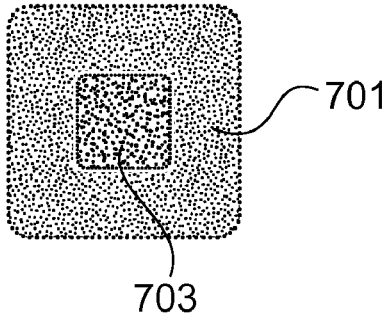
FIG. 7 is a top view of a brush according to another embodiment of the present invention.

It is to be noted that a ferrule 105 according to the present invention may comprise any shape or size in accordance with various desired tuft shapes and sizes. Furthermore, the shape of the protruding tuft 103 may be identical to or different from the shape of the base tuft 101. For example, FIGS. 5-7 illustrate different base tuft shapes, such as a 4-point star 501, a triangle 601 and a square 701 (when seen from a top view). In FIGS. 5 and 7, the shape of the protruding tufts 503, 703 is the same as the shape of their respective base tufts 501, 701. FIG. 6 illustrates an example in which a protruding tuft 603 shape (circular) is different from a base tuft 601 shape (which is, e.g., triangular).

Any shape or configuration of the protruding tuft may be contemplated. In addition, a top edge of the protruding tuft (e.g., as seen from a side view) may be provided in various configurations, such as a curved or rounded edge (as shown, e.g., in FIG. 2), flat, angled, multi-planar (e.g., having multiple edges), etc. The top edge of the protruding tuft may be the same shape/contour or a different shape/contour as a top edge of the base tuft. Further, the bristles of the protruding tuft may be configured to be uniform or terminate at slightly different lengths to form a 'feathered' effect.

The present invention advantageously provides a brush having an enhanced range of use via a unique bristle arrangement, wherein a protruding tuft is provided comprised of bristles extending from a base tuft at an interior portion thereof. A bristle arrangement according to the present invention may be used for cosmetics, artwork, crafts, etc. and advantageously provides a single brush head which is suitable for a wide variety of tasks contemporaneously, including both detailed work as well as work requiring broad coverage, as well as special effects.

Although the embodiment which incorporates the teachings of the present invention has been shown and described in detail herein, those skilled in the art can readily devise many other varied embodiments that still incorporate these teachings. Having described preferred embodiments for an improved applicator brush (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An applicator brush useful for applying materials in the fields of cosmetics and arts and crafts comprising:

a base tuft comprised of bristles affixed to a ferrule at a first end, said bristles having a second end terminating to form a base tuft edge; and only a single protruding tuft comprised of bristles arranged in a dome-shape having a curved edge that extends down to the base tuft edge, wherein the single protruding tuft protrudes from an interior portion of the base tuft, wherein the single protruding dome-shaped tuft in combination with the base tuft is useful for applying materials in detailed and broad coverage applications in cosmetics and arts and crafts.

2. The brush of claim 1, wherein the protruding tuft is affixed to the ferrule at a first end.

3. The brush of claim 1, wherein a cross-sectional shape of the protruding tuft is the same as a cross-sectional shape of the base tuft.

4. The brush of claim 1, wherein a cross-sectional shape of the protruding tuft is different from a cross-sectional shape of the base tuft.

5. The brush of claim 1, wherein a shape of the ferrule determines the shape of the base tuft.

6. The brush of claim 1, wherein the longest bristles of the protruding tuft extend beyond the base tuft a distance of at least about 20 percent of a length of the base tuft.

7. The brush of claim 1, wherein the bristles of the protruding tuft have a second end terminating to form an edge.

8. The brush of claim 7, wherein the edge of the protruding tuft has a different configuration than the edge of the base tuft.

9. The brush of claim 1, wherein the bristles of at least one of the protruding and base tufts comprise antimicrobial bristles.

10. An applicator brush useful for applying materials in the fields of cosmetics and arts and crafts consisting of:

a base tuft comprised of bristles affixed to a ferrule at a first end, said bristles having a second end terminating to form a base tuft edge;

only a single protruding tuft comprised of bristles arranged in a dome-shape having a curved edge that extends down to the base tuft edge, wherein the single protruding tuft protrudes from an interior portion of the base tuft; and a handle affixed to the ferrule, wherein the single protruding dome-shaped tuft in combination with the base tuft is useful for applying materials in detailed and broad coverage applications in cosmetics and arts and crafts.

11. The brush of claim 10, wherein the protruding tuft is affixed to the ferrule at a first end.

12. The brush of claim 10, wherein a cross-sectional shape of the protruding tuft is the same as a cross-sectional shape of the base tuft.

13. The brush of claim 10, wherein a cross-sectional shape of the protruding tuft is different from a cross-sectional shape of the base tuft.

14. The brush of claim 10, wherein the longest bristles of the protruding tuft extend beyond the base tuft a distance of at least about 20 percent of a length of the base tuft.

15. The brush of claim 10, wherein the bristles of the protruding tuft have a second end terminating to form an edge.

16. The brush of claim 15, wherein the edge of the protruding tuft has a different configuration than the edge of the base tuft.

17. The brush of claim 10, wherein the bristles of at least one of the protruding and base tufts comprise antimicrobial bristles.

* * * * *